US005189240A

United States Patent [19]

Kawashima

[11] Patent Number: 5,189,240

[45] Date of Patent: Feb. 23, 1993

[54] BREATH CONTROLLER FOR MUSICAL INSTRUMENTS

[75] Inventor: Susumu Kawashima, Hamamatsu, Japan

[73] Assignee: Yamaha Corporation, Hamamatsu, Japan

[21] Appl. No.: 401,630

[22] Filed: Aug. 31, 1989

[30] Foreign Application Priority Data

Sep. 2, 1988 [JP] Japan ..... 63-220731

[51] Int. Cl.[5] ..... G10H 3/06; G10H 1/02

[52] U.S. Cl. ..... 84/724; 84/738

[58] Field of Search ..... 84/93, 670, 671, 672, 84/718, 723, 724, 743, 380 R, 383 R, 398; 341/27, 31; 250/231.19

[56] References Cited

U.S. PATENT DOCUMENTS

| | | | |
|---|---|---|---|
| 3,040,583 | 6/1962 | Post | 250/231.19 X |
| 3,439,106 | 4/1969 | Goodale | 84/724 |
| 3,483,304 | 12/1969 | Jenny | 84/724 |
| 3,733,953 | 5/1973 | Ferber | 84/743 X |
| 3,767,833 | 10/1973 | Noble et al. | 84/687 X |
| 4,028,977 | 6/1977 | Ryeczek . | |
| 4,038,895 | 8/1977 | Clement et al. | 84/687 |
| 4,085,646 | 4/1978 | Naumann | 84/633 |
| 4,580,479 | 4/1986 | Bonanno | 84/626 |
| 4,815,353 | 3/1989 | Christian | 84/724 |
| 4,915,008 | 4/1990 | Sakashita | 84/658 |

FOREIGN PATENT DOCUMENTS

| | | |
|---|---|---|
| 63-2998 | 1/1988 | Japan . |
| 63-28475 | 8/1988 | Japan . |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

A breath controller for musical instruments includes a mouth piece for blowing the air into an air chamber. Blowing the air makes an air pressure increase in the air chamber, thus an elastic member is displaced corresponding to the air pressure. At the same time, the displacement of a reflection surface changes an amount of light to reflect an emitted light from a light-emitting element to a light-receiving element. The light-receiving element then controls a signal corresponding to the amount of light, thus making the signal change to a musical tone signal.

15 Claims, 5 Drawing Sheets

BREATH CONTROLLER FOR MUSICAL INSTRUMENTS

BACKGROUND OF THE INVENTION

1. Field of the Invention

The present invention relates to a breath controller for musical instruments which detects a blowing pressure thereby to generate a musical tone such as a tone pitch, tone color, tone volume, sound effect, and the like for use in a keyboard and wind electronic musical instrument, and the like.

2. Prior Art

Conventional type of a breath controller is disclosed in the Japanese utility-model laid-open application No. 63-2998. This breath controller comprises a box member having an air chamber communicated to a mouth piece; a permanent magnet fixed to a elastic member, this combination of which is attached in the box member to receive the blowing pressure from mouth piece; and a hall element facing the permanent magnet. Accordingly, when a player blows the air into the air chamber, both the elastic member and permanent magnet are deformed by the blowing pressure to change the distance between the permanent magnet and the hall element, so that the hall element generates a voltage signal which is changed in respect to the blowing air pressure.

However, the voltage signal is not stable in case of such construction, therefore it is difficult to adjust the voltage signal for maintaining an operating level. A multi-stage amplifier is required to obtain a wide range of the operating level so that a very small voltage is generated from the hall element, while it is required that this amplifier must be a high sensitivity (S/N ratio). In addition, the hall element probably generates an unexpected voltage signal when the permanent magnet receives an influence on a magnetic field caused by an electro-mechanical apparatus, power source, speaker, and the like, which are adjacently arranged around the permanent magnet.

SUMMARY OF THE INVENTION

It is accordingly an object of the present invention to provide a breath controller for musical instruments which is low cost so that the construction is simple.

It is another object of the present invention to provide a breath controller for musical instruments which accurately detects a blowing pressure without an external influence.

It is another object of the present invention to provide a breath controller for musical instruments which only requires simple adjustment to obtain a stable output signal.

In an aspect of the invention, there is provided a breath controller for musical instruments comprising: an enclosure having an air chamber communicated to a mouth piece; an elastic member having a reflection surface which is displaced by the blowing pressure; a light-emitting element for emitting a light to the reflection surface; a light-receiving element for receiving a reflected light, in which the reflected light is converted into a signal in response to an amount of the reflected light; and a musical tone generator for generating a musical tone in response to the signal.

The elastic member is arranged in the enclosure so that it isolates the air chamber from the light-emitting and receiving elements, so that the blowing pressure is accurately transferred to the elastic member.

The light-emitting and receiving elements are arranged under the elastic member, the opposite side of which has a reflection surface, so that an emitted light is stabley reflected from the reflection surface without an externally interference.

A good light reflection provides a stable output signal output from the light-receiving element, so that only a simple adjustment is required to obtain a signal which is converted into a musical tone signal.

DESCRIPTION OF THE PREFERRED EMBODIMENT

Figure 1:
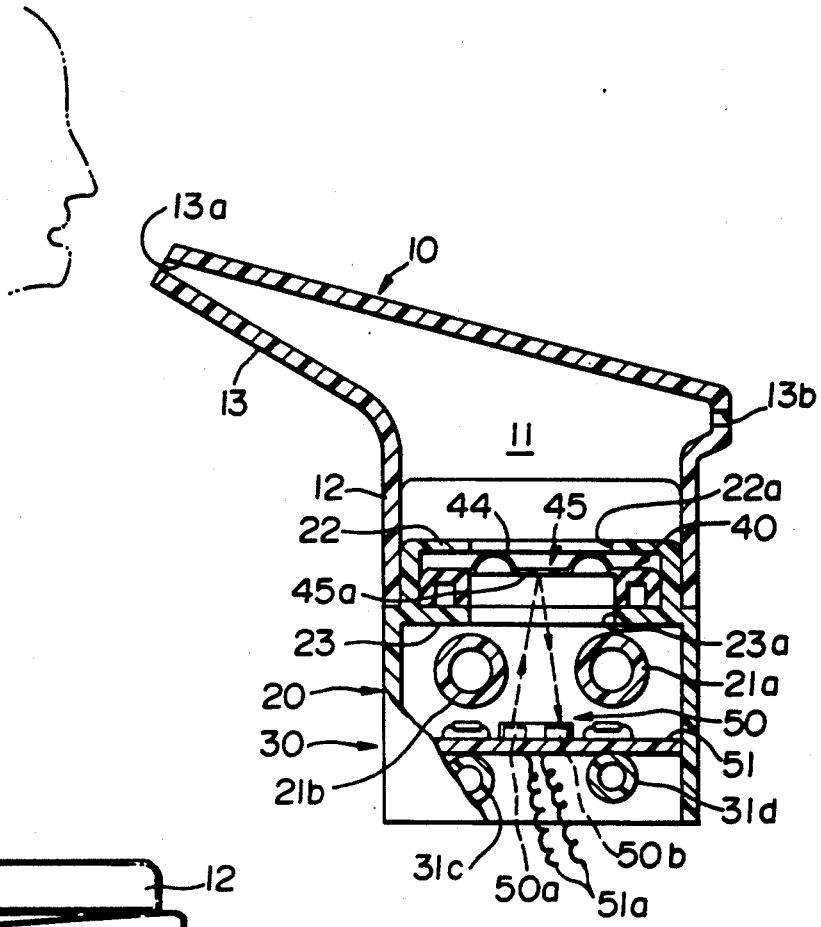
FIG. 1 is a section view showing a construction of a breath controller of an embodiment.

Hereinafter, an embodiment of the present invention is described by reference to drawings. In this embodiment, FIG. 1 shows a breath controller. This breath controller comprises casing 10; first and second lower casings 20 and 30, both of which are coupled to the lower side of casing 10; and elastic member 40 and photoreflector 50, both of which are incorporated in mounting plates which are formed in both the first and second lower casings 20 and 30, in which photoreflector 50 comprises a light-emitting element which emits a light, and a light-receiving element which receives the light emitted from the light-emitting element.

Casing 10 is formed by a plastic molding process. This casing 10 comprises rectangular casing 12 having air chamber 11, and piping portion 13 formed above rectangular casing 12. Piping portion 13 has mouth piece **13*a* to blow the air, and relief hole 13*b* to relief the air from air chamber 11**.

Figure 2:
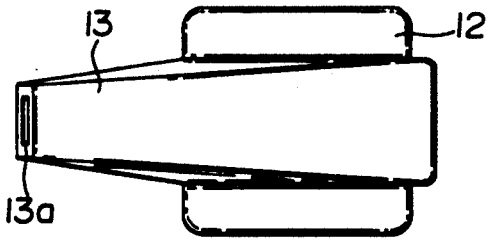
FIG. 2 is a plan view showing the breath controller.
Figure 3:
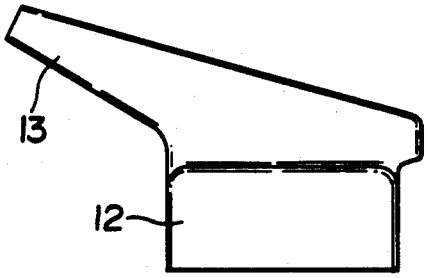
FIG. 3 is a side view showing the breath controller.
Figure 4:
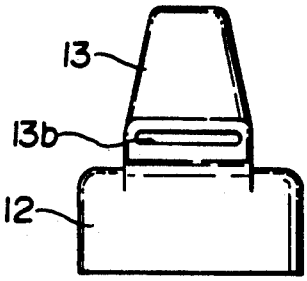
FIG. 4 is a front view showing the breath controller.

First lower casing 20 and second lower casing 30 are also formed by the plastic molding process, in which the type of a plastic material is similar to that of casing 10. Accordingly, these casing 10, first lower casing 20, and second lower casing 30 are bonded together to form a box-like member as shown in FIG. 2, FIG. 3, and FIG. 4. These figures show three different views, therefore the details of the description are omitted for the sake of simplicity.

Figure 7:
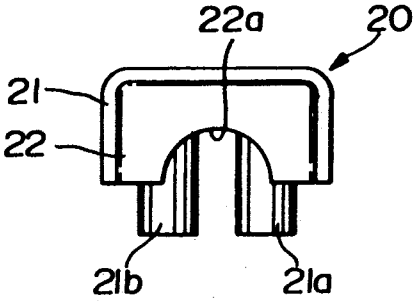
FIG. 7 is a plan view showing the first lower casing.
Figure 5:
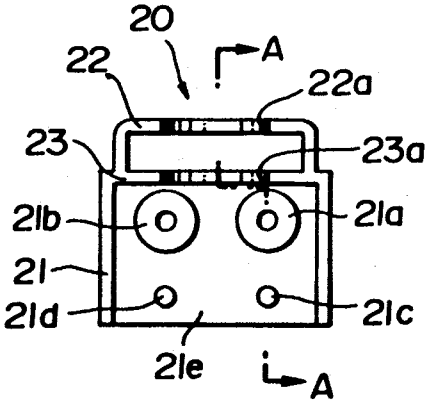
FIG. 5 is a front view showing the first lower casing.
Figure 6:
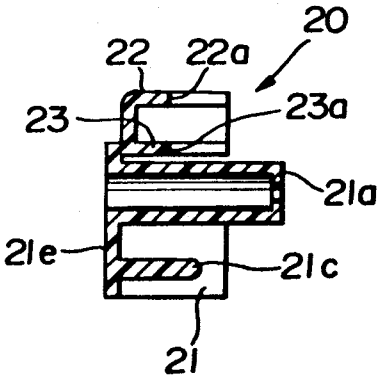
FIG. 6 is a section view shown by the arrow A—A in FIG. 5.

FIGS. 5, 6, and 7 show first lower casing 20. In FIG. 5, first lower casing 20 comprises side walls 21, both of which are faced to each other; rear wall 21e lain on both vertical edges of side walls 21; lateral plate 23 lain on both upper edges of side walls 21; and cover 22 positioned at predetermined space from the top of lateral plate 23, a lid of cover 22 encloses a predetermined area of lateral plate 23.

In FIG. 6, a pair of sleeves 21a and 21b is laterally extended from rear wall 21e to couple to other part, each end surface of sleeves 21a and 21b therefore has a hole for penetrating a mounting screw. A pair of projections 21c and 21d is also laterally extended from rear wall 21e to determine its position by inserting both projections 21c and 21d into other parts.

In FIG. 7, half circular cuttings 22a and 23a are formed with cover 22 and lateral plate 23, respectively, in which the circumference of these half circular cuttings 22a and 23a is identical, and the both are a coaxial position. Accordingly, such first lower casing 20 is integrally formed by the plastic molding process.

Figure 9:
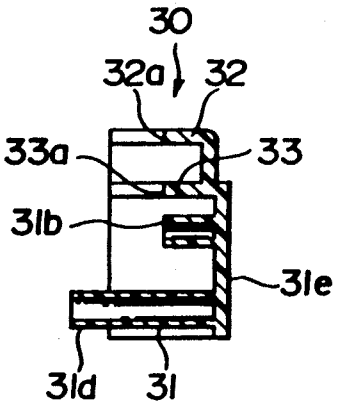
FIG. 9 is a section view shown by the arrow B—B in FIG. 8.
Figure 10:
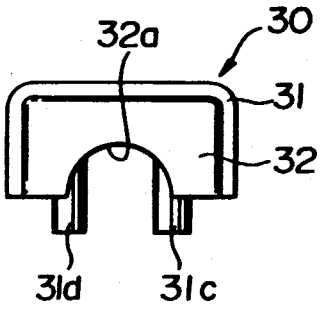
FIG. 10 is a plan view showing the second lower casing.
Figure 8:
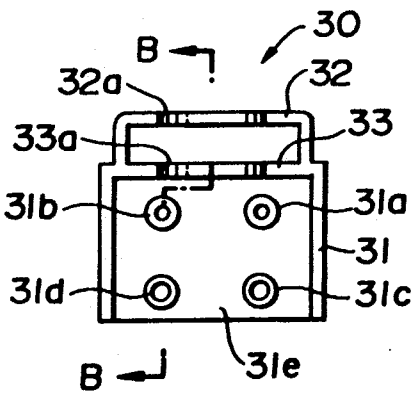
FIG. 8 is a front view showing the second lower casing.

FIGS. 8, 9, and 10 show second lower casing 30. The second lower casing 30 is a symmetrical construction with respect to first lower casing 20, this casing is integrally formed by a plastic molding process. The construction is therefore briefly described in this case. In FIG. 8, second lower casing 30 comprises side walls 31; rear wall 31e lain on both vertical edges of side walls 31; lateral plate 33 lain on both upper edges of side walls 31; and cover 32.

In FIGS. 8, 9 and 10 a pair of sleeves 31a and 31b is laterally extended from rear wall 31e to meet sleeves 21a and 21b of first lower casing 20, respectively, in which each of sleeves 31a and 31b has a hole to be screwed by a screw which is inserted from each opening of sleeves 21a and 21b. A pair of sleeves 31c and 31d is also extended from rear wall 31e to engage with projections 21c and 21d before screwing sleeves 21a and 21b to sleeves 31a and 31b.

Then, half circular cuttings 32a and 33a are formed with cover 32 and lateral plate 33, respectively. These half circular cuttings 32a and 33a are identical to half circular cuttings 22a and 23a formed with first lower casing 20, therefore, by coupling first lower casing 20 to second lower casing 30, two complete circular holes are formed by covers 22 and 32, and lateral plates 23 and 33, respectively. These holes are communicated to air chamber 11 of casing 10 as shown in FIG. 1.

Figure 11:
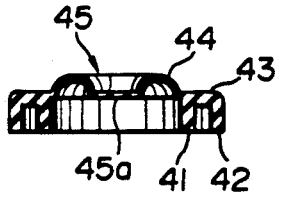
FIG. 11 is a section view showing the elastic member.
Figure 13:
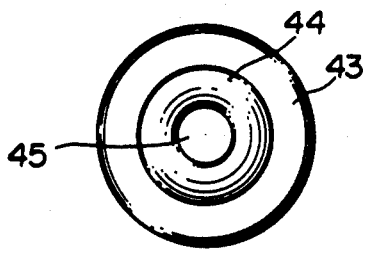
FIG. 13 is a top view showing the elastic member.
Figure 12:
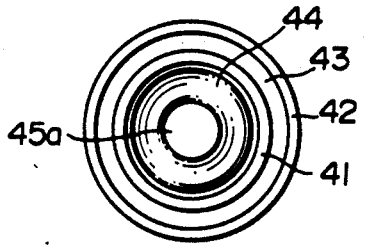
FIG. 12 is a bottom view showing the elastic member.

FIGS. 11, 12, and 13 show elastic member 40 which is integrally formed by the plastic molding process. The elastic member 40 is made of a synthetic rubber having a good elasticity and applying a white color thereto, to have a high reflection factor. This elastic member 40 is mounted on lateral plate 23 and lateral plate 33 so that elastic members 40 closes the hole. This construction is shown in FIG. 1.

Elastic member 40 is a circular-like plate as shown in FIGS. 12 and 13. Elastic member 40 has two circular lids 41 and 42 concentrically. Both circular lids 41 and 42 are extended from circular plane portion 43 as shown in FIG. 11. In addition, circular ridge 44 is extended from circular plane portion 43, then the center of circular ridge 44 has a flat dent. This flat dent and circular ridge 44 are referred to as a diaphragm 45. The thickness of circular ridge 44 and diaphragm 45 is very thin, and the section of circular ridge 44 is formed with a half circular shape, thus diaphragm 45 is readily displaced in the axis direction when the blowing pressure applies thereto, in other words, circular ridge 44 has an elasticity. In reversing side of the flat dent of diaphragm 45, a flat projection portion is formed to have reflection surface 45a for reflecting a light.

Reflection surface 45a has applied by the white color, but a plating can be applied thereto, even a thin film having a high reflection factor.

Photoreflector 50 is then described as shown in FIG. 1. Photoreflector 50 comprises light-emitting diode 50a emitting an infrared ray and phototransistor 50b receiving the infrared ray, both of which are mounted on printed circuit board 51 so that light-emitting diode 50a emits the infrared ray to reflection surface 45a, then phototransistor 50b receives the infrared ray reflected by reflection surface 45a. Printed circuit board 51 is fixedly mounted on sleeves 31c and 31d, then a D.C. voltage is supplied to the circuit including light-emitting diode 50a and phototransistor 50b through leads 51a.

Accordingly, to assemble the breath controller firstly, elastic member 40 is mounted on lateral plate 33 of second lower casing 30 so that diaphragm 45 meets directly above the hole formed by half circular cuttings 23a and 33a. Secondly, printed circuit board 51 having photoreflector 50 is fixedly mounted on sleeves 31c and 31d. Thirdly, projections 21c and 21d are inserted into sleeves 31c and 31d, respectively, to couple first lower casing 20 to second lower casing 30, then two screws are inserted from the opening ends of sleeves 21a and 21b into sleeves 31a and 31b to couple each other. Finally, a unit of the first lower casing 20 and second lower casing 30 is inserted into the opening side of rectangular casing 12 as far as a shoulder portion of first and second lower casings 20 and 30 is touched to the end surface of rectangular casing 12. In such case, the unit of the casings can be inserted into rectangular casing 12 by a press fit, even fixed by a glue. In the above description, it is relatively simple construction, thus the manufacturing cost is low.

Accordingly, in FIG. 1, when the player blows from mouth piece 13a into air chamber 11, an air pressure in air chamber 11 is increased, and at the same time, a small amount of air is discharged to the outside through relief hole 13b. Diaphragm 45 is then displaced from an original position to the lower direction. While the player stops blowing, the air pressure in air chamber 11 is decreased, thus diaphragm 45 is returned to the original position by a restoring force of circular ridge 44. The displacement of diaphragm 45 changes a distance between reflector 45a and light-emitting diode 50a, and between reflector 45a and phototransistor 50b, so that the amount of infrared ray is changed in order to displace diaphragm 45. As a result, an output voltage of phototransistor 50b is changed corresponding to the amount of infrared ray which is emitted from light-emitting diode 50a, and reflected by reflector 45a, then received by phototransistor 50b. Phototransistor 50b outputs a voltage signal corresponding to the amount of a received infrared ray. Accordingly, the blowing pressure is accurately detected in response to the output voltage from phototransistor 50b.

Figure 14:
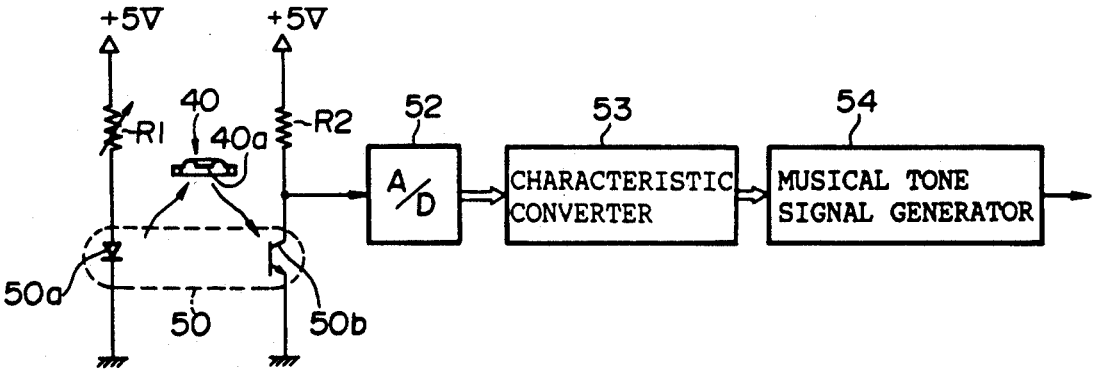
FIG. 14 is a circuit diagram for detecting a blowing pressure.

FIG. 14 shows a block diagram for detecting a blowing pressure. The anode of the light-emitting diode 50a is connected to D.C. power supply (+5V) through resister R1, while the cathode of the light-emitting diode 50a is grounded. The collector of phototransistor 50b is connected to D.C. power supply (+5V) through resister R2, the emitter of the phototransistor 50b is grounded. Light-emitting diode 50*a* emits an infrared ray to reflector 45*a* as long as the +5V is supplied to the anode of the light-emitting diode 50*a*. The infrared ray is reflected from reflector 45, then received by phototransistor 50*b*. The collector of phototransistor 50*b* thus outputs a voltage signal to A-D converter 52. The level of the voltage signal is change corresponding to the conductivity of phototransistor 50*b* which is conducted in the amount of the infrared ray. This voltage signal is converted into a digital signal by A-D converter 52, then supplied to characteristic converter 53 to adjust the detected signal to the digital signal which is appropriate to generate a musical tone signal. This digital signal is then transferred to musical tone signal generator 54 to generate a musical tone signal having a tone pitch, tone color, tone volume, effect, and the like.

In the circuit described above, a multi-stage amplifier is not necessary to generate the musical tone signal up to the final stage shown in FIG. 14. In addition, the output voltage signal from phototransistor 50*b* is stable, so that it is not necessary to sensitively adjust the output voltage of phototransistor 50*b*.

In this embodiment, elastic member 40 can be arranged on lateral plates 23 and 33 with reversible position, that is, the side of circular ridge 44 faces photoreflector 50, in this case, reflector 45*a* is reversible as well.

Relief hole 13*b* is not always necessary to blow the air from mouth piece 13*a*.

Assuming that diaphragm 45 is not necessary to have a large displacement, diaphragm 45 can be of a flat type without circular ridge 44.

A thin film can be used instead of diaphragm 45, or elastic member 40.

Assuming that a cover is attached to the bottom of first lower casing 20 and second lower casing 30, shown in FIGS. 5 and 8, to make tight so that light does not come into the inside of both of the casings, light-emitting diode 50*a* can be of a standard type which emits an artificial light.

Figure 15:
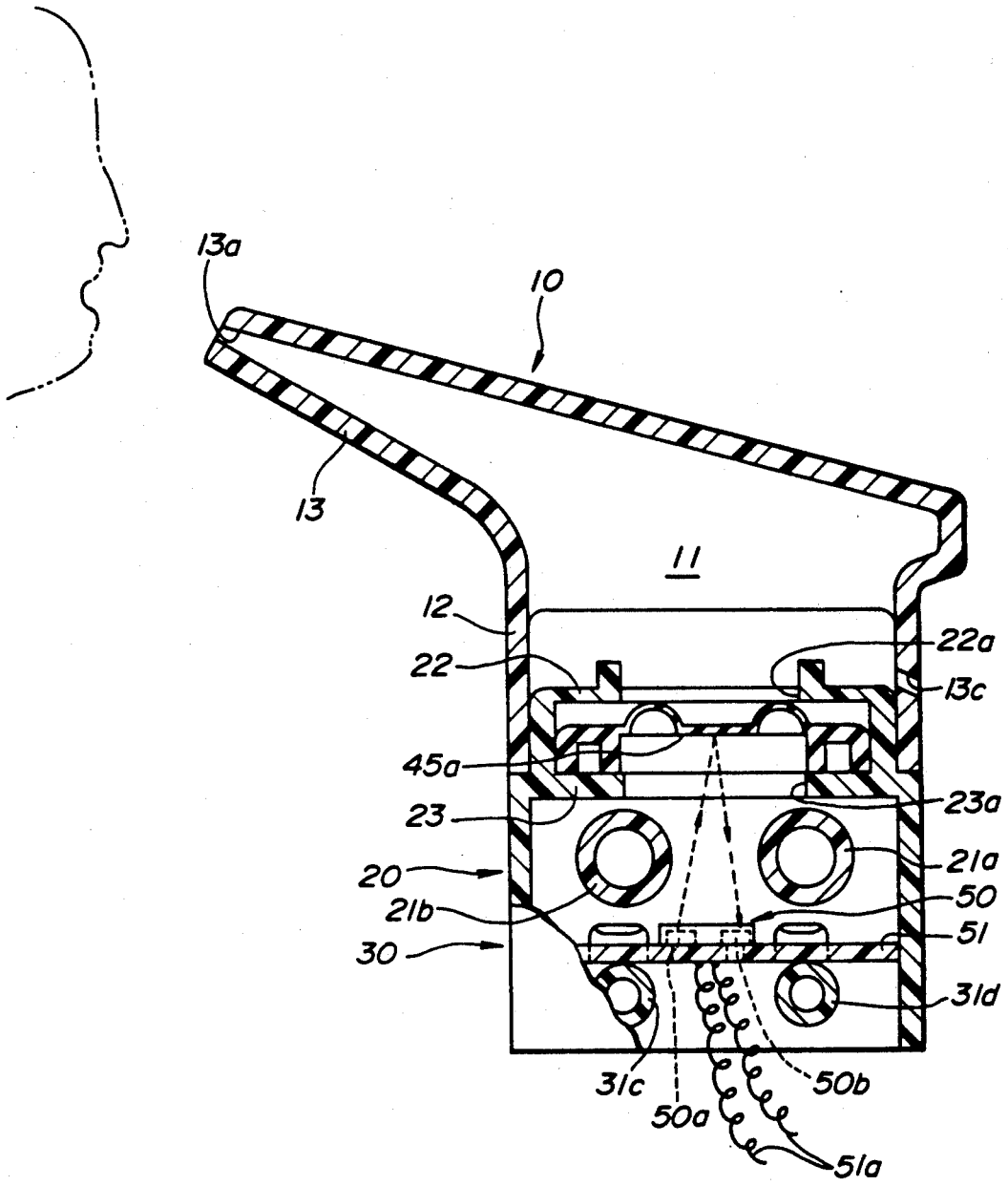
FIG. 15 is a section view showing a construction of a breath controller of another embodiment.

FIG. 15 shows another embodiment of the breath controller. This breath controller is a similar construction to the embodiment shown in FIG. 1, therefore the same reference numerals are designated in FIG. 15 and the details of the description are omitted for the sake of simplicity. The feature of this embodiment is that covers 22 and 32 have ridges integrally formed around half circular cuttings 22*a* and 32*a*, respectively. In addition, a drain hole 13*c* is formed with rectangular casing 12 to drain saliva, in which the position of the drain hole 13*c* is nearly the same level of the lateral portion formed with cover 22. Thus, the drain hole 13*c* can be used for relief of the air instead of relief hole 13*b*, therefore relief hole 13*b* is not formed in this case.

Figure 16:
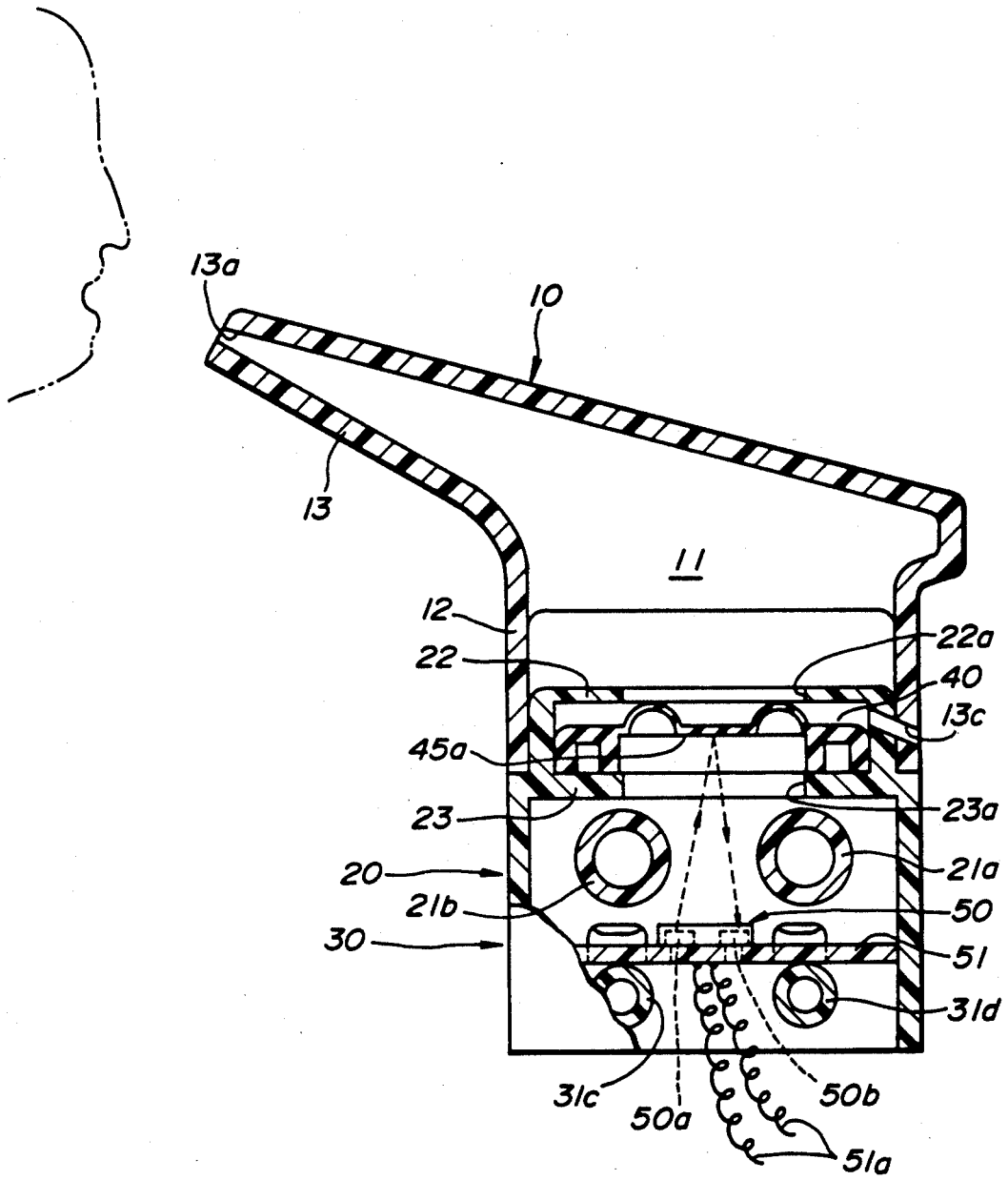
FIG. 16 is a section view showing a construction of a breath controller of another embodiment.

FIG. 16 shows another embodiment of the breath controller. The feature of this embodiment is that the drain hole 13*c* is penetrated from rectangular casing 12 to the inside of cover 22 to drain saliva in which the position of the drain hole 13*c* is nearly the same level of the lateral portion of the elastic member 40. Thus, the drain hole 13*c* can also be used for relief of the air instead of relief hole 13*b*.

The preferred embodiment described herein is illustrative and not restrictive; the scope of the invention is indicated by the appended claims and all variations which fall within the claims are intended to be embraced therein.

What is claimed is:

1. In a breath controller for musical instruments having a mouthpiece, to control musical tones in accordance with a blowing pressure, the breath controller comprising:

an enclosure which defines an air chamber coupled to the mouth piece, wherein the enclosure includes a casing having the air chamber coupled to the mouth piece, and a first lower casing and a second lower casing, the first and second lower casings being coupled together to form a hole communicated to the air chamber;

an elastic member having a reflection surface which is displaced by the blowing pressure;

a light-emitting element for emitting light to the reflection surface;

a light-receiving element for receiving reflected light from the reflection surface, wherein the amount of the reflected light varies in response to the displacement of the elastic member in accordance with the blowing pressure and the reflected light is converted into a signal corresponding to the amount of the reflected light; and a musical tone generator for generating a musical tone corresponding to the signal.

2. A breath controller according to claim 1 wherein the elastic member comprises a diaphragm displaced by the blowing pressure, and the reflection surface is formed with the diaphragm to reflect the light.

3. In a breath controller for musical instruments having a mouthpiece, to control musical tones in accordance with a blowing pressure, the breath controller comprising:

an enclosure which defines an air chamber coupled to the mouth piece;

an elastic member having a reflection surface which is displaced by the blowing pressure;

a light-emitting element for emitting light to the reflection surface;

a light-receiving element for receiving reflected light, in which the reflected light is converted into a signal corresponding to the amount of the reflected light; and a musical tone generator for generating a musical tone corresponding to the signal;

wherein the elastic member comprises a diaphragm displaced by the blowing pressure, and the reflection surface is formed with the diaphragm to reflect the light; and wherein the diaphragm comprises a circular ridge, and the reflection surface is surrounded by the circular ridge.

4. A breath controller according to claim 3 wherein the enclosure comprises a casing having the air chamber coupled to the mouth piece, and a first lower casing and a second lower casing, the first and second lower casings being coupled together to form a hole communicated to the air chamber.

5. A breath controller according to claim 4 wherein the elastic member is mounted on the hole so that the hole is closed by the elastic member.

6. A breath controller according to claim 5 wherein the diaphragm comprises a thin film formed with the reflection surface.

7. A breath controller according to claim 5 wherein the reflection surface is coated with a light reflected material.

8. A breath controller according to claim 5 wherein the light-emitting element is a light emitting diode which emits an infrared ray.

9. A breath controller according to claim 2 wherein the casing is closed so as to exclude outside light and wherein the light-emitting element is a light-emitting diode.

10. A breath controller according to claim 5 wherein the light-receiving element is a phototransistor which outputs a various level of signals corresponding to the amount of the light when the phototransistor receives the reflected light.

11. An electronic musical instrument having a mouth piece for blowing into the instrument, the instrument comprising:

an enclosure which defines an air chamber coupled to the mouth piece;

an elastic member having a light reflection surface which is positioned relative to the air chamber so as to be displaced by the pressure of blowing into the mouth piece, wherein the elastic member comprises a diaphragm having a circular ridge, and the reflection surface is surrounded by the circular ridge;

a light-emitting element for emitting light onto the reflection surface;

a light-receiving element having means for receiving light reflected from the reflection surface and means for outputting an analog signal, the magnitude of which corresponds to the amount of received reflected light, said light receiving means being positioned relative to the light reflection surface of the elastic member so that the amount of light received from the reflection surface and the magnitude of the corresponding light-receiving analog output signal vary in response to the displacement of the reflection surface by the blowing pressure; and a musical tone generator means for generating a musical tone corresponding to the analog output signal.

12. The controller of claim 11 wherein the light-receiving element is fixed and nonscanning.

13. The controller of claim 11 wherein the musical tone generator means includes an analog to digital converter for converting the analog output signal of the light-receiving element to a digital signal and means for converting the digital signal to a musical tone.

14. An electronic musical instrument having a mouth piece for blowing into the instrument, the instrument comprising:

an enclosure which defines an air chamber coupled to the mouthpiece;

an elastic diaphragm coupled to the air chamber and having a light reflection surface coated with a light reflecting material, said surface being positioned relative to the air chamber so as to be displaced by the pressure of blowing into the mouth piece, wherein the elastic member comprises a diaphragm having a circular ridge, and the reflection surface is surrounded by the circular ridge;

an infrared light-emitting element for emitting infrared light onto the reflection surface;

a phototransistor for receiving reflected infrared light from the reflection surface and for outputting an analog signal, the magnitude of which corresponds to the amount of received reflected light, said phototransistor being positioned relative to the light reflection surface of the diaphragm so that the amount of light received from the diaphragm reflection surface and the magnitude of the corresponding phototransistor analog output signal vary in response to the displacement of the reflection surface by the blowing pressure;

an analog to digital converter for converting the analog output of the phototransistor to a digital signal;

a digital musical tone generator for generating a musical tone in response to a digital input signal; and a characteristic converter coupled to the output of the analog to digital converter and to the input of the tone generator, for adjusting the digital signal output of the analog to digital converter to a digital input signal which is appropriate for the digital musical tone generator in accordance with the characteristics of the musical tone generator.

15. A breath controller according to claim 3 wherein the enclosure is closed so as to exclude outside light and wherein the light-emitting element is a light-emitting diode.

* * * * *